US011666089B2

(12) United States Patent
Rostami et al.

(10) Patent No.: US 11,666,089 B2
(45) Date of Patent: Jun. 6, 2023

(54) HEAT-NOT-BURN DEVICE AND FLAVOR CARRIER

(71) Applicant: Altria Client Services LLC, Richmond, VA (US)

(72) Inventors: Ali A. Rostami, Glen Allen, VA (US); Dmitriy S. Kirzhner, Richmond, VA (US); Eric Hawes, Midlothian, VA (US); Yezdi Pithawalla, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 880 days.

(21) Appl. No.: 16/375,191

(22) Filed: Apr. 4, 2019

(65) Prior Publication Data

US 2020/0315256 A1 Oct. 8, 2020

(51) Int. Cl.
*A24F 40/20* (2020.01)
*A24B 15/167* (2020.01)

(52) U.S. Cl.
CPC ..... *A24F 40/20* (2020.01); *A24B 15/167* (2016.11)

(58) Field of Classification Search
CPC ..... A24F 40/20; A24B 15/167
See application file for complete search history.

(56) References Cited

U.S. PATENT DOCUMENTS

| | | | | |
|---|---|---|---|---|
| 4,123,592 | A * | 10/1978 | Rainer | A24B 15/282 131/275 |
| 9,004,073 | B2 | 4/2015 | Tucker et al. | |
| 2014/0041655 | A1* | 2/2014 | Barron | A24F 40/46 128/202.21 |
| 2014/0261486 | A1 | 9/2014 | Potter et al. | |
| 2015/0027468 | A1 | 1/2015 | Li et al. | |
| 2018/0184710 | A1* | 7/2018 | Tucker | H05B 1/0244 |

FOREIGN PATENT DOCUMENTS

| | | | |
|---|---|---|---|
| GB | 2513631 | A | 11/2014 |
| WO | WO-2014/110119 | A1 | 7/2014 |
| WO | WO-2015/040180 | A2 | 3/2015 |

OTHER PUBLICATIONS

Chinese Office Action dated Dec. 20, 2021 for corresponding Chinese Application No. 202080040255.4.
European Communication pursuant to Article 94(3) EPC dated Nov. 10, 2022 for corresponding European Application No. 20722014.6.

* cited by examiner

*Primary Examiner* — Galen H Hauth
*Assistant Examiner* — Yana B Krinker
(74) *Attorney, Agent, or Firm* — Harness, Dickey & Pierce, P.L.C.

(57) ABSTRACT

A flavor carrier for an aerosol-generating device includes an outer housing extending in a longitudinal direction, an inner housing extending in the longitudinal direction, and a flavor chamber between the outer housing and the inner housing. The outer housing includes at least one outer housing perforation defined in a wall of the outer housing. The inner housing includes at least one inner housing perforation defined in a wall of the inner housing. The flavor chamber is configured to contain a flavoring material.

32 Claims, 6 Drawing Sheets

HEAT-NOT-BURN DEVICE AND FLAVOR CARRIER

BACKGROUND

Field

The present disclosure relates to capsules, heat-not-burn (HNB) aerosol-generating devices, and methods of generating an aerosol without involving a substantial pyrolysis of the aerosol-forming substrate.

Description of Related Art

Some electronic devices are configured to heat a plant material to a temperature that is sufficient to release constituents of the plant material while keeping the temperature below a combustion point of the plant material so as to avoid any substantial pyrolysis of the plant material. Such devices may be referred to as aerosol-generating devices (e.g., heat-not-burn aerosol-generating devices), and the plant material heated may be tobacco. In some instances, the plant material may be introduced directly into a heating chamber of an aerosol-generating device. In other instances, the plant material may be pre-packaged in individual containers to facilitate insertion and removal from an aerosol-generating device.

SUMMARY

At least one example embodiment relates to a flavor carrier for an aerosol-generating device.

In at least one example embodiment, a flavor carrier for an aerosol-generating device includes an outer housing extending in a longitudinal direction, an inner housing extending in the longitudinal direction, and a flavor chamber between the outer housing and the inner housing. The outer housing includes at least one outer housing perforation defined in a wall of the outer housing. The inner housing is coaxial with the outer housing. The inner housing includes at least one inner housing perforation defined in a wall of the inner housing. The flavor chamber is configured to contain a flavoring material.

In at least one example embodiment, an adapter is at an end of the flavor carrier. The adapter is configured to secure the flavor carrier within an aerosol-generating device. The adapter defines a channel therein. The channel is in fluid communication with an air passage defined in the inner housing. The adapter is formed of at least one of a polymer and a metal, the adapter being substantially impermeable to aerosol.

In at least one example embodiment, the flavor carrier further comprises a gasket at a second end of the flavor carrier. The gasket is substantially impermeable to aerosol. The gasket is formed of at least one of a polymer and a metal.

In at least one example embodiment, the outer housing has an outer diameter ranging from about 3.0 mm to about 10.0 mm or from about 3.0 mm to about 5.0 mm. The inner housing has an outer diameter ranging from about 1.0 mm to about 3.0 mm.

In at least one example embodiment, the flavoring material includes at least one of a botanical material, a gel, a film, and a flavor bead.

In at least one example embodiment, at least one of the wall of the outer housing and the wall of the inner housing has a thickness ranging from about 0.5 mm to about 1.5 mm.

At least one of the wall of the outer housing and the wall of the inner housing is formed of at least one of paper, a fabric, a metal, and a polymer.

At least one example embodiment relates to an aerosol generating device.

In at least one example embodiment, an aerosol generating device includes plant material, a heating element configured to heat the plant material, and a flavor carrier. The flavor carrier includes an outer housing extending in a longitudinal direction, an inner housing extending in the longitudinal direction, and a flavor chamber between the outer housing and the inner housing. The outer housing includes at least one outer housing perforation defined in a wall of the outer housing. The inner housing is coaxial with the outer housing. The inner housing includes at least one inner housing perforation defined in a wall of the inner housing. The flavor chamber is configured to contain a flavoring material.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

FIG. 12 is a cross-sectional view along line XI-XI of a flavor cartridge according to at least one example embodiment.

DETAILED DESCRIPTION OF EXAMPLE EMBODIMENTS

Figure 1:
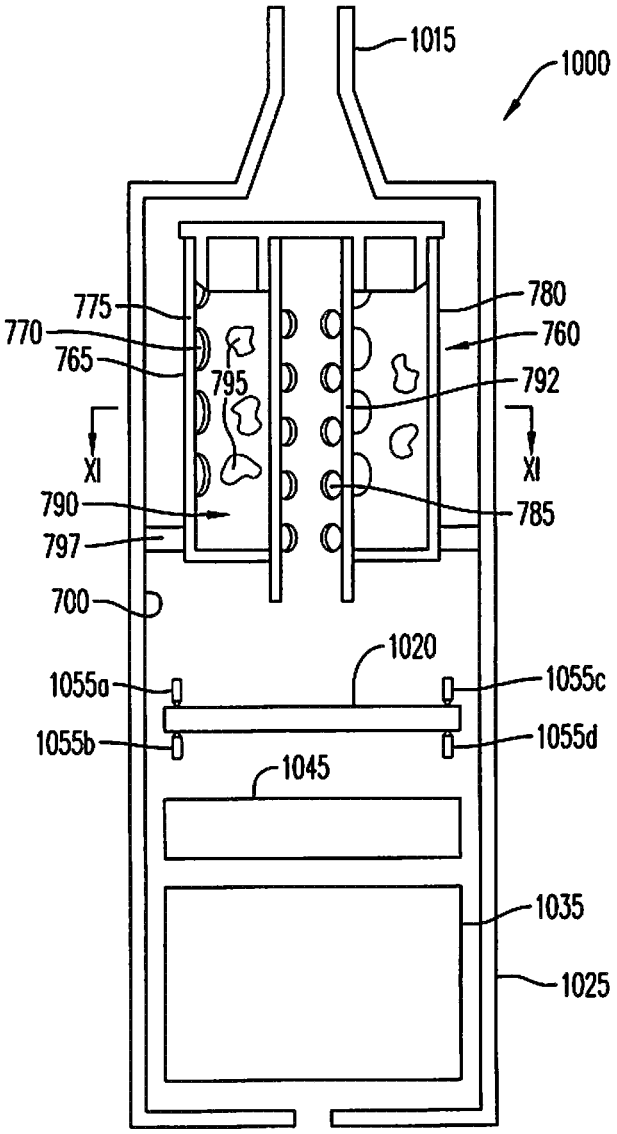
FIG. 1 is a schematic view of an aerosol-generating device according to an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," "attached to," "adjacent to," or "covering" another element or layer, it may be directly on, connected to, coupled to, attached to, adjacent to or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, component, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

When the words "about" and "substantially" are used in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1 is a schematic view of an aerosol-generating device according to an example embodiment.

Referring to FIG. 1, an aerosol-generating device 1000 (e.g., heat-not-burn aerosol-generating device) may include a mouthpiece 1015 and a device body 1025. A power source 1035 and control circuitry 1045 may be disposed within the device body 1025 of the aerosol-generating device 1000. The aerosol-generating device 1000 is configured to receive a capsule 1020, which may include plant material, such as tobacco as described in U.S. patent application Ser. No. 16/252,951, filed Jan. 21, 2019 titled "CAPSULES, HEAT-NOT-BURNG (HNB) AEROSOL-GENERATING DEVICES, AND METHODS OF GENERATING AN AEROSOL," the entire content of which is incorporated herein by reference thereto.

As discussed herein, an aerosol-forming substrate is a material or combination of materials that may be transformed into an aerosol. An aerosol relates to the matter generated or output by the devices disclosed, claimed, and equivalents thereof. The material may include a compound (e.g., nicotine, cannabinoid), wherein an aerosol including the compound is produced when the material is heated. The heating may be below the combustion temperature so as to produce an aerosol without involving a substantial pyrolysis of the aerosol-forming substrate or the substantial generation of combustion byproducts (if any). Thus, in an example embodiment, pyrolysis does not occur during the heating and resulting production of aerosol. In other instances, there may be some pyrolysis and combustion byproducts, but the extent may be considered relatively minor and/or merely incidental.

The aerosol-forming substrate may be a fibrous material. For instance, the fibrous material may be a botanical material. The fibrous material is configured to release a compound when heated. The compound may be a naturally occurring constituent of the fibrous material. For instance, the fibrous material may be plant material such as tobacco, and the compound released may be nicotine. The term "tobacco" includes any tobacco plant material including tobacco leaf, tobacco plug, reconstituted tobacco, compressed tobacco, shaped tobacco, or powder tobacco, and combinations thereof from one or more species of tobacco plants, such as *Nicotiana rustica* and *Nicotiana tabacum*.

In some example embodiments, the tobacco material may include material from any member of the genus *Nicotiana*. In addition, the tobacco material may include a blend of two or more different tobacco varieties. Examples of suitable types of tobacco materials that may be used include, but are riot limited to, flue-cured tobacco, Burley tobacco, Dark tobacco, Maryland tobacco, Oriental tobacco, rare tobacco, specialty tobacco, blends thereof, and the like. The tobacco material may be provided in any suitable form, including, but: not limited to, tobacco lamina, rocessed tobacco materials, such as volume expanded or puffed tobacco, processed tobacco stems, such as cut-rolled or cut-puffed stems, reconstituted tobacco materials, blends thereof, and the like. In some example embodiments, the tobacco material is in the form of a substantially dry tobacco mass. Furthermore, in some instances, the tobacco material may be mixed and/or combined with at least one of propylene glycol, glycerin, sub-combinations thereof, or combinations thereof.

The compound may also be a naturally occurring constituent of a medicinal plant that has a medically-accepted therapeutic effect. For instance, the medicinal plant may be a *Cannabis* plant, and the compound may be a cannabinoid. Cannabinoids interact with receptors in the body to produce a wide range of effects. As a result, cannabinoids have been used for a variety of medicinal purposes (e.g., treatment of pain, nausea, epilepsy, psychiatric disorders). The fibrous material may include the leaf and/or flower material from one or more species of *Cannabis* plants such as *Cannabis sativa, Cannabis indica,* and *Cannabis ruderalis.* In some instances, the fibrous material is a mixture of 60-80% (e.g., 70%) *Cannabis sativa* and 20-40% (e.g., 30%) *Cannabis indica.*

Examples of cannabinoids include tetrahydrocannabinolic acid (THCA), tetrahydrocannabinol (THC), cannabidiolic acid (CBDA), cannabidiol (CBD), cannabinol (CBN), cannabicyclol (CBL), cannabichromene (CBC), and cannabigerol (CBG). Tetrahydrocannabinolic acid (THCA) is a precursor of tetrahydrocannabinol (THC), while cannabidiolic acid (CBDA) is precursor of cannabidiol (CBD). Tetrahydrocannabinolic acid (THCA) and cannabidiolic acid (CBDA) may be converted to tetrahydrocannabinol (THC) and cannabidiol (CBD), respectively, via heating. In an example embodiment, heat from the first heater 110 and/or the second heater 120 may cause decarboxylation so as to convert the tetrahydrocannabinolic acid (THCA) in the capsule 100 to tetrahydrocannabinol (THC), and/or to convert the cannabidiolic acid (CBDA) in the capsule 100 to cannabidiol (CBD).

In instances where both tetrahydrocannabinolic acid (THCA) and tetrahydrocannabinol (THC) are present in the capsule 100, the decarboxylation and. resulting conversion will cause a decrease in tetrahydrocannabinolic acid (THCA) and an increase in tetrahydrocannabinol (THC). At least 50% (e.g., at least 87%) of the tetrahydrocannabinolic acid (THCA) may be converted to tetrahydrocannabinol (THC) during the heating of the capsule 100. Similarly, in instances where both cannabidiolic acid (CBDA) and cannabidiol (CBD) are present in the capsule 100, the decarboxylation and resulting conversion will cause a decrease in cannabidiolic acid (CBDA) and an increase in cannabidiol (CBD). At least 50% (e.g., at least 87%) of the can.nabidiolic acid (CBDA) may be converted to cannabidiol (CBD) during the heating of the capsule 100.

Alternatively, the compound may be a non-naturally occurring additive that is subsequently introduced into the fibrous material. In such an instance, the fibrous material may include at least one of cotton, polyethylene, polyester, rayon, combinations thereof, or the like (e.g., in a form of a gauze). In another instance, the fibrous material may be a cellulose material, and the compound introduced may be nicotine, cannabinoids, and/or flavorants by way of plant extracts (e.g., tobacco extract, *Cannabis* extract).

In at least one example embodiment, the aerosol-generating device 1000 may also include a first electrode 1055*a,* a second electrode 1055*b,* a third electrode 1055*c,* and a fourth electrode 1055*d* configured to electrically contact the capsule 1020. In at least one example embodiment, the first electrode 1055*a* and the third electrode 1055*c* may electrically contact the first heater 110*a,* while the second electrode 1055*b* and the fourth electrode 1055*d* may electrically contact the second heater 110*b.* However, in non-limiting embodiments involving a capsule with only one heater, it should be understood that the first electrode 1055*a* and the third electrode 1055*c* (or the second electrode 1055*b* and the fourth electrode 1055*d*) may be omitted.

When the capsule 1020 is inserted into the aerosol-generating device 1000, the control circuitry 1045 may instruct the power source 1035 to supply an electric current to the first electrode 1055*a,* the second electrode 1055*b,* the third electrode 1055*c*, and/or the fourth electrode 1055*d.* The supply of current from the power source 1035 may be in response to a manual operation (e.g., button-activation) or an automatic operation (e.g., puff-activation). As a result of the current, the capsule 1020 may be heated to generate an aerosol. Additional details of the capsule 1020 and the aerosol-generating device 1000, including the mouthpiece 1015, the device body 1025, the power source 1035, the control circuitry 1045, the first electrode 1055*a*, the second electrode 1055*b,* the third electrode 1055*c,* and the fourth electrode 1055*d* may be found in U.S. application Ser. No. 15/845,501, filed Dec. 18, 2017, titled "VAPORIZING DEVICES AND METHODS FOR DELIVERING A COMPOUND USING THE SAME,", the disclosure of which is incorporated herein in its entirety by reference.

In at least one example embodiment, as shown in FIG. 1, aerosol-generating device 1000 may also include a flavor carrier 760. The flavor carrier 760 may include an outer housing 765 extending in the longitudinal direction, an inner housing 780 extending in the longitudinal direction, and a flavor chamber 790 between the outer housing 765 and the inner housing 780. The outer housing 765 and/or the inner housing 780 may be generally cylindrical. In other example embodiments, a cross-section of the outer housing 765 and/or the inner housing 780 may be generally oval, rectangular, square, triangular, polygonal and/or may have any other cross-sectional shape. In some example embodiments, a cross section of the outer housing 765 may have generally the same shape as a cross section of the inner housing 780. In some example embodiments, a cross section of the outer housing 765 may have a different shape than a cross section of the inner housing 780. The outer housing 765 includes at least one outer housing perforation 770 defined in a wall 775 of the outer housing 765. In at least one example embodiment, the inner housing 780 may be coaxial with the outer housing 765. In other example embodiments, the inner housing 780 is not coaxial with the outer housing 765. In some example embodiments, the inner housing 780 is within the outer housing 765. In some example embodiments, at least a portion of the inner housing 780 is within at least a portion of the outer housing 765. In some example embodiments, an area of a cross-section of the inner housing 780 is smaller than an area of a cross-section of the outer housing 765. In some example embodiments, a cross section of the inner housing 780 is generally circular and a cross section of the outer housing 765 is generally circular, and a diameter of the cross section of the inner housing 780 is smaller than a diameter of the cross section of the outer housing 765. Other arrangements or variations may be used in other example embodiments. The inner housing 780 includes at least one inner housing perforation 785 defined in a wall 792 of the inner housing 780. The flavor chamber 790 is configured to contain a flavoring material 795.

In at least one example embodiment, an adapter 797 is at an end of the flavor carrier 760. The adapter 797 is configured to secure the flavor carrier 760 within the device body 1025 of the aerosol-generating device 1000. The adapter 797 may be a ring-shaped body that fits snugly about an outer surface of the outer housing 765 of the flavor carrier 760. The adapter 797 is sized to friction fit between the outer housing 765 of the flavor carrier 760 and an inner surface 700 of the device body 1025 of the aerosol-generating device 1000.

In at least one example embodiment, the adapter 797 is formed of one or more materials including a polymer, a metal, a sub-combination thereof, or a combination thereof. The adapter 797 is substantially impermeable to aerosol so that the aerosol is forced to flow through the flavor carrier 760, where the aromas and/or flavors from flavoring material 795 are eluted to the aerosol.

In at least one example embodiment, the outer housing 765 of the flavor carrier 760 is a hollow cylinder having an outer diameter ranging from about 3.0 mm to about 10.0 mm (e.g., about 3.0 mm to about 5.0 mm, about 3.5 mm to about 4.5 mm or about 3.75 mm to about 4.25 mm, etc.). In other example embodiments, the outer housing 765 of the flavor carrier 760 is a hollow cylinder having an outer diameter that is less than about 3.0 mm, or greater than about 10.0 mm.

In at least one example embodiment, the inner housing 780 is a hollow cylinder having an outer diameter ranging from about 1.0 mm to about 3.0 mm (e.g., about 1.5 mm to about 2.5 mm, about 1.75 mm to about 2.25 mm, etc.). In other example embodiments, the inner housing 780 of the flavor carrier 760 is a hollow cylinder having an outer diameter that is less than about 1.0 mm, or greater than about 3.0 mm. The diameter of the inner housing 780 and the outer housing 765 may be chosen to provide a desired volume of the flavor chamber 790 defined between the inner housing 780 and the outer housing 765.

In at least one example embodiment, the wall 775 of the outer housing 765 and the wall 792 of the inner housing 780, or each have a thickness ranging from about 0.5 mm to about 1.5 mm (e.g., about 0.75 mm to about 1.25 mm). In some example embodiments, the wall 775 and/or the wall 792 have thicknesses that are smaller than about 0.5 mm, or greater than about 1.5 mm. In some example embodiments, the wall 775 of the outer housing 765 and the wall 792 of the inner housing 780, or both are formed of one or more materials that include paper, a fabric, a metal, a polymer and/or any other suitable materials.

In at least one example embodiment, the flavoring material 795 includes a botanical material, a gel, a film, flavor bits, powders, discs of compressed powders, a flavor bead and/or any other flavoring materials. In some example embodiments, the botanical material may include tobacco plant material, *Cannabis* plant material and/or other botanical material. In other example embodiments, the botanical material may include non-tobacco botanical material, such as teas, herbs, etc.

In some example embodiments, the flavoring material 795 may include a gel. The gel may include a polymer, one or more flavorants and/or botanical material suspended in the gel.

In other example embodiments, the flavoring material 795 may include a film. The film may be formed of at least one polymer and one or more flavorants. The film or films may be in flavor chamber 790, rolled around the inner housing 780 and/or provided in a tube form, such that the tube is inserted in flavor chamber 790 around the inner housing 780. In some examples, the film may be water soluble and/or may disintegrate when exposed to heat, such that the film disintegrates as aerosol passes through the flavor chamber 790. In other examples, the film may be porous. Other types of films may be used.

In some example embodiments, the flavoring material 795 includes flavor beads include at least one polymer and at least one flavorant. The flavor beads may include an outer shell enclosing an inner core. The inner core and/or the outer shell may contain menthol or other volatile flavors. For example, the inner core can contain mint flavors such as peppermint, spearmint or any other flavors.

In at least one example embodiment, the flavor beads can each have a diameter ranging from about 0.5 mm to about 5 mm (e.g., about 1 mm to about 4 mm, about 2 mm to about 3 mm, etc.). In other example embodiments, the flavor beads can each have a diameter that is smaller than about 0.5 mm or greater than about 5 mm. The flavor beads can be manufactured and/or include the features of the flavor beads and/or flavor capsules disclosed in U.S. Pat. No. 7,878,962 to Karles et aL, which issued Feb. 1, 2011, and U.S. Pat. No. 7,578,298 to Karles et al., which issued Aug. 25, 2009, the entire content of each of which is incorporated herein by this reference thereto.

In at least one example embodiment, the flavoring material 795 is in the form of a paper impregnated and/or coated with one or more flavorants.

In some example embodiments, where the flavoring material 795 is a film or paper, the film or paper may be chopped before being placed in the flavor chamber 790. In some example embodiments, the chopped film or paper may be mixed with at least one botanical material and/or with flavor beads.

In at least one example embodiment, the flavoring material 795 may be coated with a second material including at least one polymer and/or a flavorant. A flavorant of the coating may be the same flavorant incorporated in the flavoring material 795 underlying the coating or the flavorant of the coating may be a different flavorant that the flavorant in the underlying flavoring material 795. In at least one example embodiment, the flavoring material 795 includes cellulose material with one or more flavorants.

In at least one example embodiment, a flavorant is a volatile flavorant. In at least one example embodiment, the flavorant may be any flavorant commonly used in foods, confections, or other oral products. Example flavorants include, but are not limited to, berry flavors such as pomegranate, acai, raspberry, blueberry,strawberry, boysenberry, cranberry, etc. Other example flavorants include, without limitation, any natural or synthetic flavor or aroma, such as menthol, peppermint, spearmint, wintergreen, bourbon, scotch, whiskey, cognac, hydrangea, lavender, chocolate, licorice, citrus and other fruit flavors, such as apple, peach, pear, cherry, plum, orange, lime, grape, and grapefruit, gamma octalactone, vanillin, ethyl vanillin, breath freshener flavors, butter, rum, coconut, almond, pecan, walnut, hazelnut, French vanilla, macadamia, sugar cane, maple, cassis, caramel, banana, malt, espresso, kahlua, white chocolate, spice flavors such as cinnamon, clove, cilantro, basil, oregano, garlic, mustard, nutmeg, rosemary, thyme, tarragon, dill, sage, anise, and fennel, methyl salicylate, linalool, jasmine, coffee, olive oil, sesame oil, sunflower oil, bergamot oil, geranium oil, lemon oil, ginger oil, balsamic vinegar, rice wine vinegar, red wine vinegar, etc. One or more flavorants may be included in flavoring materials 795.

In at least one example embodiment, the flavoring material 795 includes a polymer and the polymer is a water soluble or water insoluble polymer. The polymer may be natural or synthetic. The polymers may be a hydrocolloid. Other example polymers include, without limitation, starch, dextrin, gum arabic, guar gum, chitosan, cellulose, polyvinyl alcohol, polylactide, gelatin, soy protein, whey protein, etc.

Figure 2:
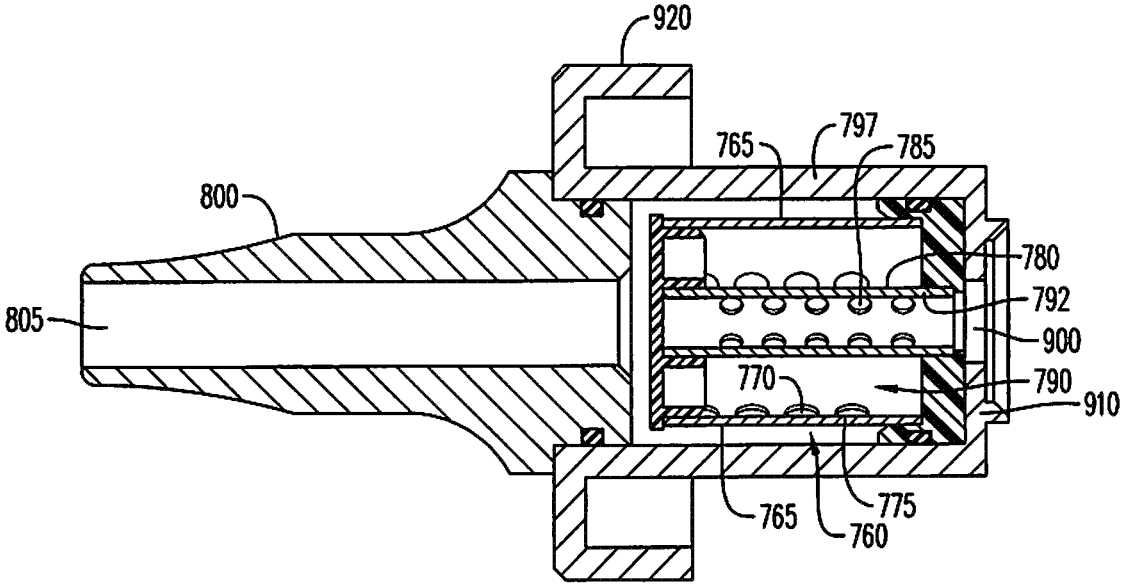
FIG. 2 is a cross-sectional view of a flavor carrier and mouthpiece of the aerosol-generating device of FIG. 1 according to at least one example embodiment.

FIG. 2 is a cross-sectional view of a flavor carrier and mouthpiece of an aerosol-generating device according to at least one example embodiment.

In at least one example embodiment, the flavor carrier 760 and a mouthpiece 800 may joined together, such that the adapter 797 surrounds a portion of the flavor carrier 760 and the mouthpiece 800 fits with an end of the adapter 797.

In at least one example embodiment, the mouthpiece 800 is formed of materials that include plastic, metal, wood and/or other suitable materials. In at least one example embodiment, the mouthpiece 800 is formed from at least one plastic material, such as polyethylene or polypropylene. The mouthpiece 800 may be rounded, and may not include any sharp edges. In other examples, the cross-section of a mouthpiece 800 may be generally rectangular, oval, square, triangular, polygonal and/or may have any other cross-sectional shape. In some example embodiments, a mouthpiece 800 may include sharp edges. In some examples, a surface of the mouthpiece 800 may be generally smooth.

The adapter 797 is generally U-shaped and cylindrical, such that the flavor carrier 760 nests within the adapter 797. A bottom wall 910 of the adapter 797 defines a channel 900 that directs aerosol into the flavor carrier 760 when the flavor carrier 760 and the adapter 797 are engaged with the device body 1025 of the aerosol-generating device 1000. The adapter 797 also includes a flange portion 920 that engages with the device body 1025 of the aerosol-generating device 1000. Thus, the flavor carrier 765 of FIG. 2 may be retrofitted with the aerosol-generating device 1000 by removing an existing mouthpiece and inserting the adapter 797 within the housing of the aerosol-generating device 1000.

Figure 3:
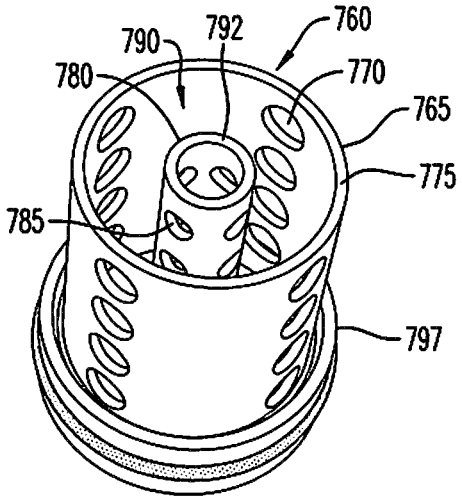
FIG. 3 is a perspective view of a flavor carrier of an aerosol-generating device according to at least one example embodiment.

FIG. 3 is a perspective view of a flavor carrier of an aerosol-generating device according to at least one example embodiment.

In at least one example embodiment, as shown in FIG. 3, the flavor carrier 760 is generally the same as in FIGS. 1 and 2, except that the perforations 785 in the wall 792 of the inner housing 780 are aligned with the perforations 770 in the wall 775 of the outer housing 765. The perforations 785 and the perforations 770 may be arranged in columns. In other example embodiments, the perforations 785 in the wall 792 of the inner housing 780 are not aligned with the perforations 770 in the wall 775 of the outer housing 765. In some example embodiments, the wall 792 and/or the wall 775 may each include 1 to about 20 columns (e.g., about 2 to about 18, about 4 to about 16, about 6 to about 14, about 8 to about 12, or about 10 to about 12) of perforations 770, 785. In some example embodiments, the wall 792 and/or the wall 775 may each include more than 20 columns. In some example embodiments, each column of perforations 770, 785 in the wall 792 and/or the wall 775 may include 1 to about 20 perforations 770, 785 (e.g., about 2 to about 18, about 4 to about 16, about 6 to about 14, about 8 to about 12, or about 10 to about 12). In some example embodiments, each column of perforations 770, 785 in the wall 792 and/or the wall 775 may include more than 20 perforations. The perforations 770, 785 may be a same or different size. The perforations 770, 785 may be generally circular in shape in some example embodiments, or may be triangular, rectangular, oval, square, poloygonal or may have any other shape. The perforations 770 may be the same or different size and/or shape than perforations 785. In some example embodiments, the perforations 770, 785 may be larger at a first end of the flavor carrier 760 than at a second end of the flavor carrier 760. In at least one example embodiment, the perforations 770, 785 at a center of the flavor carrier 760 may be larger or smaller than the perforations 770, 785 at ends of the flavor carrier. In at least one example embodiment, each the perforations 770, 785 have substantially the same diameter (e.g., about 0.1 in diameter to about 5.0 mm in diameter).

Figure 4:
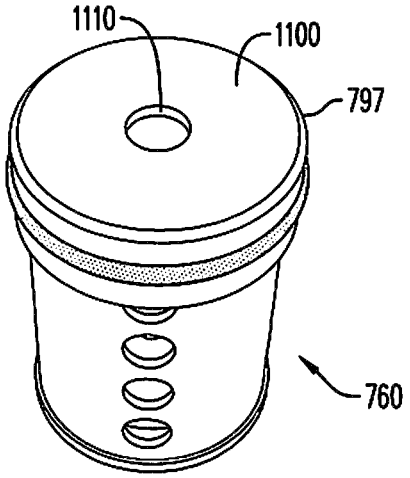
FIG. 4 is a perspective view of a flavor carrier of an aerosol-generating device according to at least one example embodiment.

FIG. 4 is a perspective view of a flavor carrier of an aerosol-generating device according to at least one example embodiment.

In at least one example embodiment, as shown in FIG. 4, the flavor carrier 760 is generally the same as in FIGS. 1 and 2, except that the adapter 797 is in the form of a cover 1100 that is placed over an end of the flavor carrier 760. The cover 1100 also defines a channel 1110 therein. Aerosol is directed into the inner housing 780, then through the perforations 785 in the wall 792 of the inner housing 780 and into the flavor chamber 790. The aerosol may then flow out of the flavor chamber 790 via the perforations 770 in the wall 775 of the outer housing 765.

Figure 5:
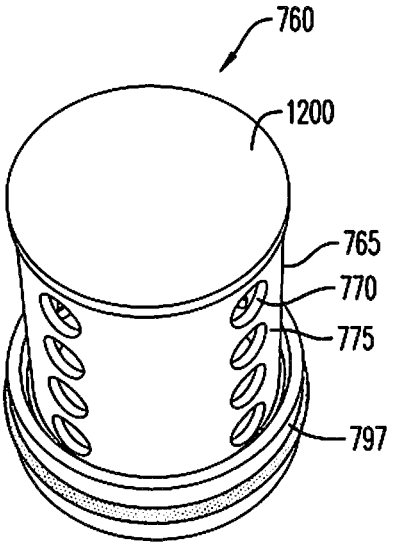
FIG. 5 is a perspective view of a flavor carrier of an aerosol-generating device according to at least one example embodiment.

FIG. 5 is a perspective view of a flavor carrier of an aerosol-generating device according to at least one example embodiment.

In at least one example embodiment, as shown in FIG. 5, the flavor carrier 760 is generally the same as in FIGS. 1 and 2, except that the flavor carrier 760 further comprises a gasket 1200 at a second end of the flavor carrier 760. The gasket 1200 is substantially impermeable to aerosol, so as to force aerosol to pass through the perforations 770 in the wall 775 of the outer housing 765 of the flavor carrier 760. The gasket 1200 is formed of one or more materials including a polymer, a metal or a combination thereof, and/or other suitable materials. In at least one example embodiment, the gasket 1200 is formed of one or more materials that include a food-grade, GRAS (generally recognized as safe) material.

Figure 6:
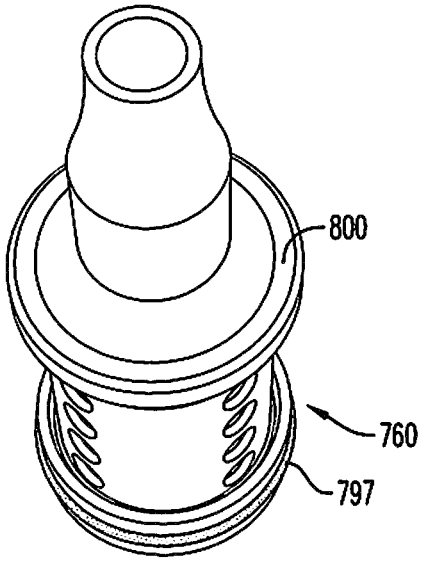
FIG. 6 is a perspective view of a flavor carrier of an aerosol-generating device according to at least one example embodiment.

FIG. 6 is a perspective view of a flavor carrier of an aerosol-generating device according to at least one example embodiment.

In at least one example embodiment, as shown in FIG. 6, the mouthpiece 800 fits around an end portion of the flavor carrier 760.

Figure 7:
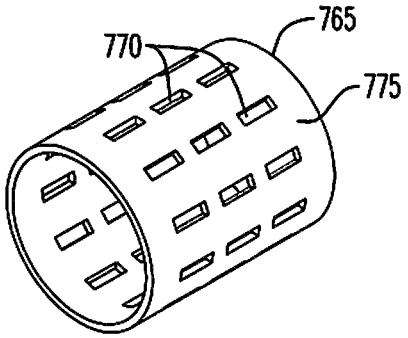
FIG. 7 is a perspective view of a flavor carrier of an aerosol-generating device according to at least one example embodiment.

FIG. 7 is a perspective view of an outer housing of a flavor carrier according to at least one example embodiment.

In at least one example embodiment, perforations 770 of outer housing 765 are elongated and extend parallel to the longitudinal direction of the flavor carrier 760. As shown, the perforations 770 may be generally rectangular in shape. In at least one example embodiment, the perforations 785 of inner housing 780, not shown, may be the same or different than the perforations 770 shown in FIG. 7, for example, in shape, size and/or pattern, etc. The perforations 785 may align with the perforations 770 and may be about a same size. In other example embodiments, the perforations 785 may have a different size and/or may not align with the perforations 770.

Figure 8:
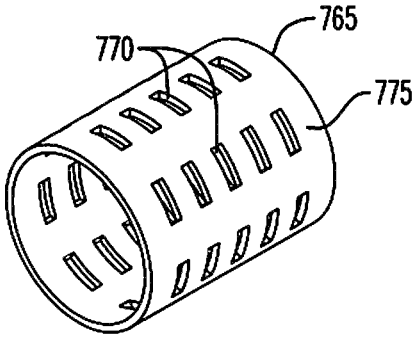
FIG. 8 is a perspective view of a flavor carrier of an aerosol-generating device according to at least one example embodiment.

FIG. 8 is a perspective view of a flavor carrier of an aerosol-generating device according to at least one example embodiment.

In at least one example embodiment, the perforations 770 of the outer housing 765 are elongated and extend perpendicular to the longitudinal direction of the flavor carrier 760.

In an example embodiment, the perforations 785 of inner housing 780, not shown, may be the same or different than the perforations 770 shown in FIG. 8, for example, in shape, size and/or pattern, etc. The perforations 785 may align with the perforations 770 and may be about a same size. In other example embodiments, the perforations 785 may have a different size and/or may not align with the perforations 770.

Figure 9:
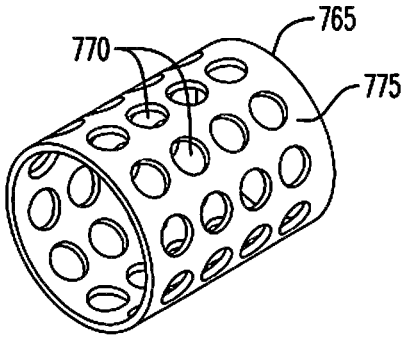
FIG. 9 is a perspective view of a flavor carrier of an aerosol-generating device according to at least one example embodiment.

FIG. 9 is a perspective view of a flavor carrier of an aerosol-generating device according to at least one example embodiment.

In at least one example embodiment, as shown in FIG. 9, the perforations 770 of outer housing 765 are generally circular or oval in shape and are arranged in uniform rows and/or columns along outer housing 765.

In an example embodiment, the perforations 785 of inner housing 780, not shown, may be the same or different than the perforations 770 shown in FIG. 9, for example, in shape, size and/or pattern, etc. The perforations 785 may align with the perforations 770 and may be about a same size. In other example embodiments, the perforations 785 may have a different size and/or may not align with the perforations 770.

Figure 10:
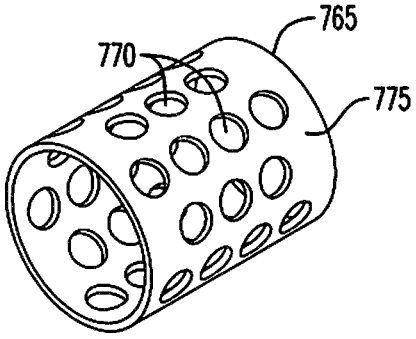
FIG. 10 is a perspective view of a flavor carrier of an aerosol-generating device according to at least one example embodiment.

FIG. 10 is a perspective view of a flavor carrier of an aerosol-generating device according to at least one example embodiment.

In at least one example embodiment, as shown in FIG. 10, the flavor carrier 760 is generally the same as in FIGS. 1-2, except that the perforations are generally circular in shape and are arranged in offset rows along the flavor carrier 760.

The perforations 785, not shown may be the same or different than the perforations 770. The perforations 785 may align with the perforations 770 and may be about a same size. In other example embodiments, the perforations 785 may have a different size and/or may not align with the perforations 770.

Figure 11:
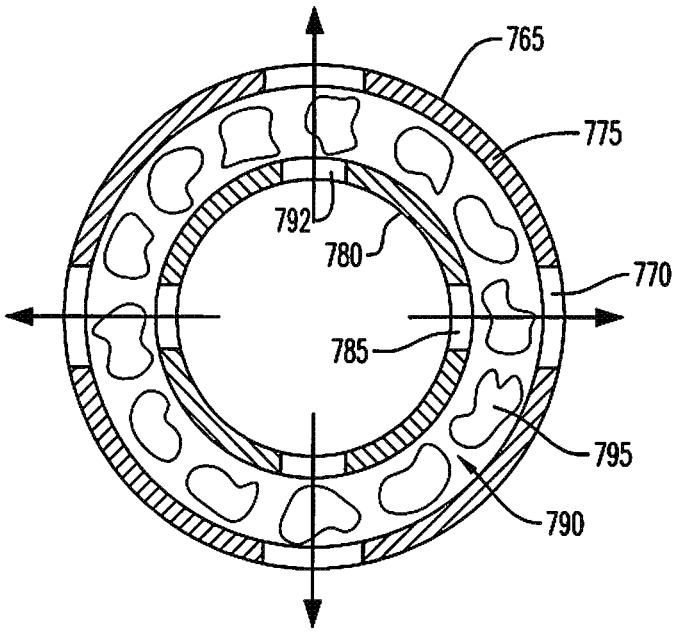

FIG. 11 is a cross-sectional view along line XI-XI of the flavor cartridge of FIG. 1 according at least one example embodiment.

As shown in FIG. 11, in some example embodiments, the perforations 785 in the wall 792 of the inner housing 780 align with the perforations 770 in the wall 775 of the outer housing 765.

Figure 12:
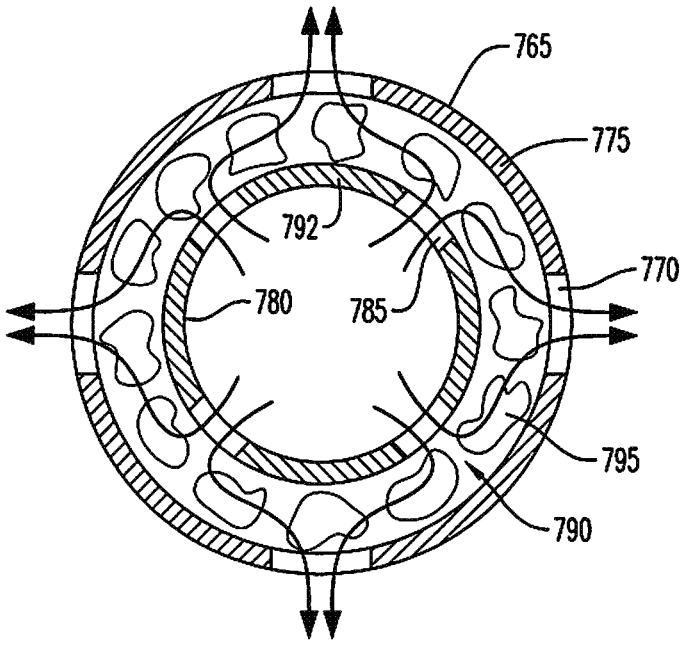
FIG. 12 is a cross-sectional view along line XI-XI of the flavor cartridge of FIG. 1 according at least one example embodiment.

FIG. 12 is a cross-sectional view of a flavor cartridge according to at least one example embodiment.

As shown in FIG. 12, in some example embodiments, the perforations 785 in the wall 792 of the inner housing 780 do not align with the perforations 770 in the wall 775 of the outer housing 765, such that a tortuous flow path is formed through the flavor chamber 790.

Figure 13:
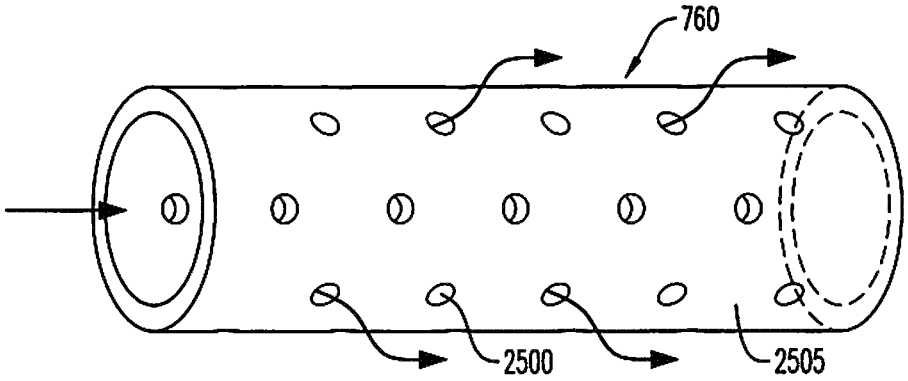
FIG. 13 is a perspective view of a flavor cartridge according to at least one example embodiment.

FIG. 13 is a perspective view of a flavor cartridge according to at least one example embodiment.

In at least one example embodiment, as shown in FIG. 13, one or more features of a flavor carrier 760 are generally the same as one or more features that have been described herein, except that instead of including the outer housing 765 and the inner housing 780 with a flavor chamber 790 therebetween, the flavor carrier 760 is formed of a tube 2505 of paper impregnated with at least one flavorant. The tube 2505 has a thickness that is about the same as the gap between the outer housing 765 and the inner housing 780 as described herein. The tube 2505 includes a plurality of perforations 2500 therein. The perforations 2500 may be in any desired shape and/or configuration.

Figure 14:
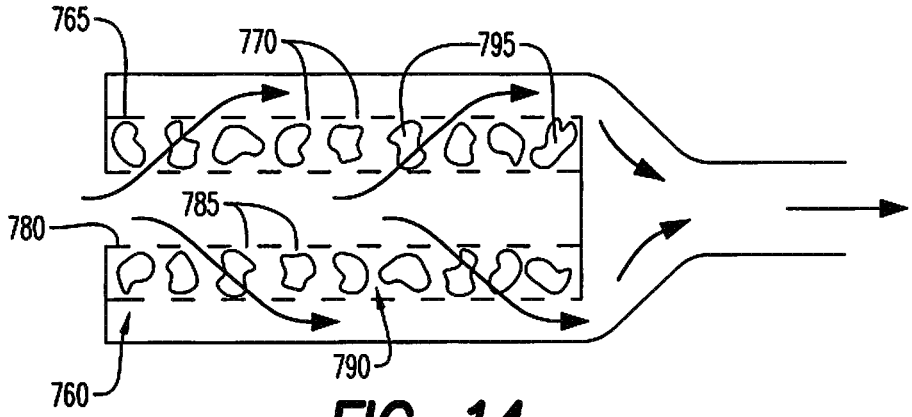
FIG. 14 is a schematic view showing airflow through an aerosol-generating device including a flavor carrier according to at least one example embodiment.

FIG. 14 is a schematic view showing airflow through an aerosol-generating device including a flavor carrier according to at least one example embodiment.

In one example embodiment shown in FIG. 14, aerosol (shown by the arrows) generated by the aerosol-generating device 1000 enters the inner housing 780 and flows laterally through inner housing perforations 785, through flavor material 795 in flavor chamber 790, and through outer housing perforations 770 into a space between outer housing 765 and a device body of the aerosol-generating device 1000, and exits through a mouth end of the aerosol-generating device. As the aerosol passes through the flavor material 795, aromas, flavors and/or components from flavor material 795 may be eluted to the aerosol. In some example embodiments, some of the aerosol or portions of the aerosol may be filtered out as the aerosol flows through the flavor carrier 760.

In some example embodiments, not shown, the flavor carrier may include one or more feature from one or more embodiments described herein.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. An aerosol generating device comprising:
- a device body;
- a mouthpiece at an end of the device body;
- plant material in the device body;
- a heating element in the device body, the heating element configured to heat the plant material; and
- a flavor carrier in the device body, the flavor carrier between the heating element and the mouthpiece, the flavor carrier including,
  - an outer housing extending in a longitudinal direction, the outer housing including,
    - an outer housing wall defining at least one outer housing perforation,
  - an inner housing extending in the longitudinal direction, the inner housing coaxial with the outer housing, the outer housing and the inner housing defining a flavor chamber, the flavor chamber configured to contain a flavoring material, the inner housing including,
    - an inner housing wall defining at least one inner housing perforation,
  - a cover at a first end of the flavor carrier, and
  - a gasket at a second end of the flavor carrier, the gasket excluding a channel therethrough, and the gasket being impermeable to aerosol.

2. The aerosol generating device of claim 1, wherein the cover defines a channel therein, the channel in fluid communication with an air passage defined by the inner housing.

3. The aerosol generating device of claim 1, wherein the gasket is formed of one or more materials including a polymer, a metal, or both a polymer and a metal.

4. The aerosol generating device of claim 1, wherein the outer housing has an outer diameter ranging from 3.0 mm to 5.0 mm.

5. The aerosol generating device of claim 1, wherein the inner housing has an outer diameter ranging from 1.0 mm to 3.0 mm.

6. The aerosol generating device of claim 1, wherein the flavoring material includes a botanical material, a gel, a film, flavor bits, a powder, a compressed powder, a flavor bead, or any combination thereof.

7. The aerosol generating device of claim 1, wherein the outer housing wall and the inner housing wall each have a thickness ranging from 0.5 mm to 1.5 mm.

8. The aerosol generating device of claim 1, wherein the outer housing wall and the inner housing wall are each formed of one or more materials including a paper, a fabric, a metal, a polymer, or any combination thereof.

9. The aerosol generating device of claim 1, wherein the at least one outer housing perforation includes a plurality of perforations.

10. The aerosol generating device of claim 9, wherein the plurality of outer housing perforations are arranged in at least one column.

11. The aerosol generating device of claim 1, wherein the at least one inner housing perforation includes a plurality of inner housing perforations.

12. The aerosol generating device of claim 11, wherein the plurality of inner housing perforations are arranged in at least one column.

13. The aerosol generating device of claim 1, further comprising:

an adapter configured to fit with a portion of the flavor carrier, the adapter being formed of one or more materials including a polymer, a metal, or both a polymer and a metal, the adapter being impermeable to aerosol.

14. The aerosol generating device of claim 1, wherein the at least one outer housing perforation includes a plurality of outer housing perforations, the at least one inner housing perforation includes a plurality of inner housing perforations, and the plurality of outer housing perforations is aligned with the plurality of inner housing perforations.

15. The aerosol generating device of claim 1, wherein the at least one outer housing perforation includes a plurality of outer housing perforations, the at least one inner housing perforation includes a plurality of inner housing perforations, and the plurality of outer housing perforations is not aligned with the plurality of inner housing perforations.

16. The aerosol generating device of claim 1, wherein the plant material includes tobacco.

17. The aerosol generating device of claim 1, further comprising an adapter configured to receive at least a portion of the flavor carrier, a first end of the adapter including a bottom wall defining a channel and a second end of the adapter including a flange portion configured to engage the device body.

18. A flavor carrier comprising:

an outer housing extending in a longitudinal direction, the outer housing including, an outer housing wall defining at least one outer housing perforation;

an inner housing extending in the longitudinal direction, the inner housing coaxial with the outer housing, the outer housing and the inner housing defining a flavor chamber, the flavor chamber configured to contain a flavoring material, the inner housing including, an inner housing wall defining at least one inner housing perforation;

a cover at a first end of the outer housing of the flavor carrier, the cover engaging the outer housing of the flavor carrier, and the cover defining a channel in a central portion thereof; and a gasket at a second end of the outer housing of the flavor carrier, the gasket excluding a channel therethrough and being impermeable to aerosol.

19. The flavor carrier of claim 18, wherein the channel is in fluid communication with an air passage defined by the inner housing.

20. The flavor carrier of claim 18, wherein the gasket is formed of one or more materials including a polymer, a metal, or both a polymer and a metal.

21. The flavor carrier of claim 18, wherein the outer housing has an outer diameter ranging from 3.0 mm to 5.0 mm.

22. The flavor carrier of claim 18, wherein the inner housing has an outer diameter ranging from 1.0 mm to 3.0 mm.

23. The flavor carrier of claim 18, wherein the flavoring material includes a botanical material, a gel, a film, flavor bits, a powder, a compressed powder, a flavor bead, or any combination thereof.

24. The flavor carrier of claim 18, wherein the outer housing wall and the inner housing wall each have a thickness ranging from 0.5 mm to 1.5 mm.

25. The flavor carrier of claim 18, wherein the outer housing wall and the inner housing wall are each formed of one or more materials including a paper, a fabric, a metal, a polymer, or any combination thereof.

26. The flavor carrier of claim 18, wherein the at least one outer housing perforation includes a plurality of perforations.

27. The flavor carrier of claim 26, wherein the plurality of outer housing perforations are arranged in at least one column.

28. The flavor carrier of claim 18, wherein the at least one inner housing perforation includes a plurality of inner housing perforations.

29. The flavor carrier of claim 28, wherein the plurality of inner housing perforations are arranged in at least one column.

30. The flavor carrier of claim 18, further comprising:

an adapter configured to fit with a portion of the flavor carrier, the adapter being formed of one or more materials including a polymer, a metal, or both a polymer and a metal, the adapter being impermeable to aerosol.

31. The flavor carrier of claim 18, wherein the at least one outer housing perforation includes a plurality of outer housing perforations, the at least one inner housing perforation includes a plurality of inner housing perforations, and the plurality of outer housing perforations is aligned with the plurality of inner housing perforations.

32. The flavor carrier of claim 18, wherein the at least one outer housing perforation includes a plurality of outer housing perforations, the at least one inner housing perforation includes a plurality of inner housing perforations, and the plurality of outer housing perforations is not aligned with the plurality of inner housing perforations.

* * * * *